US005363892A

United States Patent [19]

Hild et al.

[11] Patent Number: 5,363,892

[45] Date of Patent: Nov. 15, 1994

[54] HAND PLANING TOOL WITH A ROTATING BLADE MOUNT

[75] Inventors: Eugen Hild, Aichtal; Kai-Uwe, Floettmann Guetersloh, both of Germany

[73] Assignee: Robert Bosch GmbH, Stuttgart, Germany

[21] Appl. No.: 94,040

[22] PCT Filed: May 27, 1993

[86] PCT No.: PCT/DE92/00932

§ 371 Date: Jul. 15, 1993

§ 102(e) Date: Jul. 15, 1993

[87] PCT Pub. No.: WO93/09924

PCT Pub. Date: May 27, 1993

[30] Foreign Application Priority Data

Nov. 15, 1991 [DE] Germany ..... 4137623

[51] Int. Cl.[5] ..... B27C 1/10; B27G 13/04

[52] U.S. Cl. ..... 144/225; 30/475; 144/117 C; 144/241; 407/49

[58] Field of Search ..... 144/230, 117 R, 117 C, 144/218, 225, 241; 30/475; 407/33, 41, 46, 49, 50, 51

[56] References Cited

U.S. PATENT DOCUMENTS

| | | | |
|---|---|---|---|
| 1,071,970 | 9/1913 | Stutzman | 144/225 |
| 4,066,111 | 1/1978 | Klebe, Jr. | 144/225 |
| 4,347,882 | 9/1982 | Bachmann | 144/225 |
| 4,557,305 | 12/1985 | Berger et al. | 144/241 |
| 4,749,014 | 6/1988 | Schlund | 144/117 C |

FOREIGN PATENT DOCUMENTS

| | | |
|---|---|---|
| 0018548 | 11/1980 | European Pat. Off. . |
| 0133197 | 2/1985 | European Pat. Off. . |
| 2477460 | 9/1981 | France . |
| 2234447 | 1/1974 | Germany . |
| 3002848 | 7/1981 | Germany . |
| 619880 | 11/1980 | Switzerland . |

*Primary Examiner*—W. Donald Bray
*Attorney, Agent, or Firm*—Michael J. Striker

[57] ABSTRACT

A hand-operated planer has a rotating blade holder having a base body, at least one planing blade and a pressing plate which presses the at least one planing blade against the base body, the pressing plate having one side which presses the planing blade against the base body and another side which is formed differently from the one side so that when the pressing plate is reversed the another side can press another planing blade which is different from the planing blade against the base body.

19 Claims, 3 Drawing Sheets

HAND PLANING TOOL WITH A ROTATING BLADE MOUNT

BACKGROUND OF THE INVENTION

The present invention relates to a hand planing tool with a rotating blade holder.

More particularly, it relates to a hand-operated planer which has a base body.

A hand-operated planer with a rotating blade holder is known from EP-A 48 304. Two thin hard-metal reversible planing blades of narrow width with a profiled back and smooth base are held on the blade holder. In so doing, each pressing plate engages in a groove on the back of each planing blade in a positively locking manner with an end edge having a nose-like profile. A cover shell is supported on each pressing plate and—indirectly—presses the planing blade into its work position on the blade holder. The hard-metal reversible planing blades have two cutting edges on opposite sides so that when one of the cutting edges wears out the second cutting edge can be used by reclamping the reversible planing blade on the blade holder.

The blade holder of the known hand-operated planer is not suitable for receiving high-speed steel reversible planing blades which, according to standards, are wider and higher than hard-metal reversible planing blades, since high-speed steel planing blades do not carry a slot on the back facing the cover shell, but rather on the opposite side, that is on their base surface.

Other blade holders or clamping devices are known for high-speed steel reversible planing blades. The planing blades can be held on these blade holders or clamping devices in a displaceable manner without pressing plates by adjusting screws which engage in the slot. However, these blade holders are not suitable for holding hard-metal planing blades.

Accordingly, known hand-operated planers can only be used with a single type of planing blade, i.e. either hard-metal reversible planing blades or high-speed steel reversible planing blades. This clearly limits the possibilities for using the known hand-operated planers.

The seemingly easiest way to use known hand-operated planers with different types of planing blades would be to adapt the construction of the high-speed steel reversible planing blade to that of the hard-metal reversible planing blade, e.g. by forming a slot in its back. The slot would have to have the same dimensions as the slot of the hard-metal reversible planing blade and there would be a substantial risk of confusing the two types of planing blades. Thus—although this would probably be prohibited by law because of the danger of confusion—a completely new type of high-speed steel reversible planing blade would have to be produced at a high cost for development. Its strength characteristics would be different since its shape differs from that of the original planing blade type and in general it could not be exchangeable with the known high-speed steel reversible planing blades. This would entail a high follow-up cost because planing blades are standardized and are manufactured in large quantities by a number of manufacturers for different types of machines. Thus, it would be necessary to stock the new type of planing blade separately.

SUMMARY OF THE INVENTION

Accordingly, it is an object of the present invention to provide a hand planing tool, which avoids the disadvantages of the prior art.

In keeping with these objects and with others which will become apparent hereinafter, one feature of the present invention resides, briefly stated, in a hand-operated planer of the above mentioned type in which the pressing plate when reversed is capable of clamping differently shaped types of planing plates, particularly hard-metal reversible planing plates as well as high-speed steel reversible planing blades with a smooth back and a profiled base, particularly a base having a slot.

When the hand-operated planer is designed in accordance with the present invention, it has the advantage over the prior art that two types of standardized planing blade, in particular a hard-metal reversible planing blade and a high-speed steel reversible planing blade, can be fastened to the blade holder without the inclusion of special holding means external to the hand-operated planer.

This considerably expands the possible range of uses for the hand-operated planer without incurring special costs for a restructuring of the tools and without the need for special clamping means external to the hand-operated planer which would permit an optional clamping of hard-metal or steel planing blades.

In accordance with another feature of the present invention, the pressing plate has different gripping surfaces adapted to different holding surfaces of different planing plates.

The pressing plate can carry the different gripping surfaces on opposite sides, so that by reversing the pressing plate, the planing blade associated with the base body can be adjustably received in an optional manner.

The pressing plate can carry the different gripping surfaces at a common location, particularly on the upper side or underside at the opposite ends, so that the planing blades which are exactly associated with the gripping surface, can be received in an optional manner by rotating the pressing plate.

The high-speed steel reversible planing plate can be secured by resting on nose-like projection or on the gripping surface of the pressing plate, while the hard-metal reversible planing plate can be secured by resting directly on the base body.

The pressing plate can have openings for clamping screws or stops for adjusting screws.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENT

Figure 1:
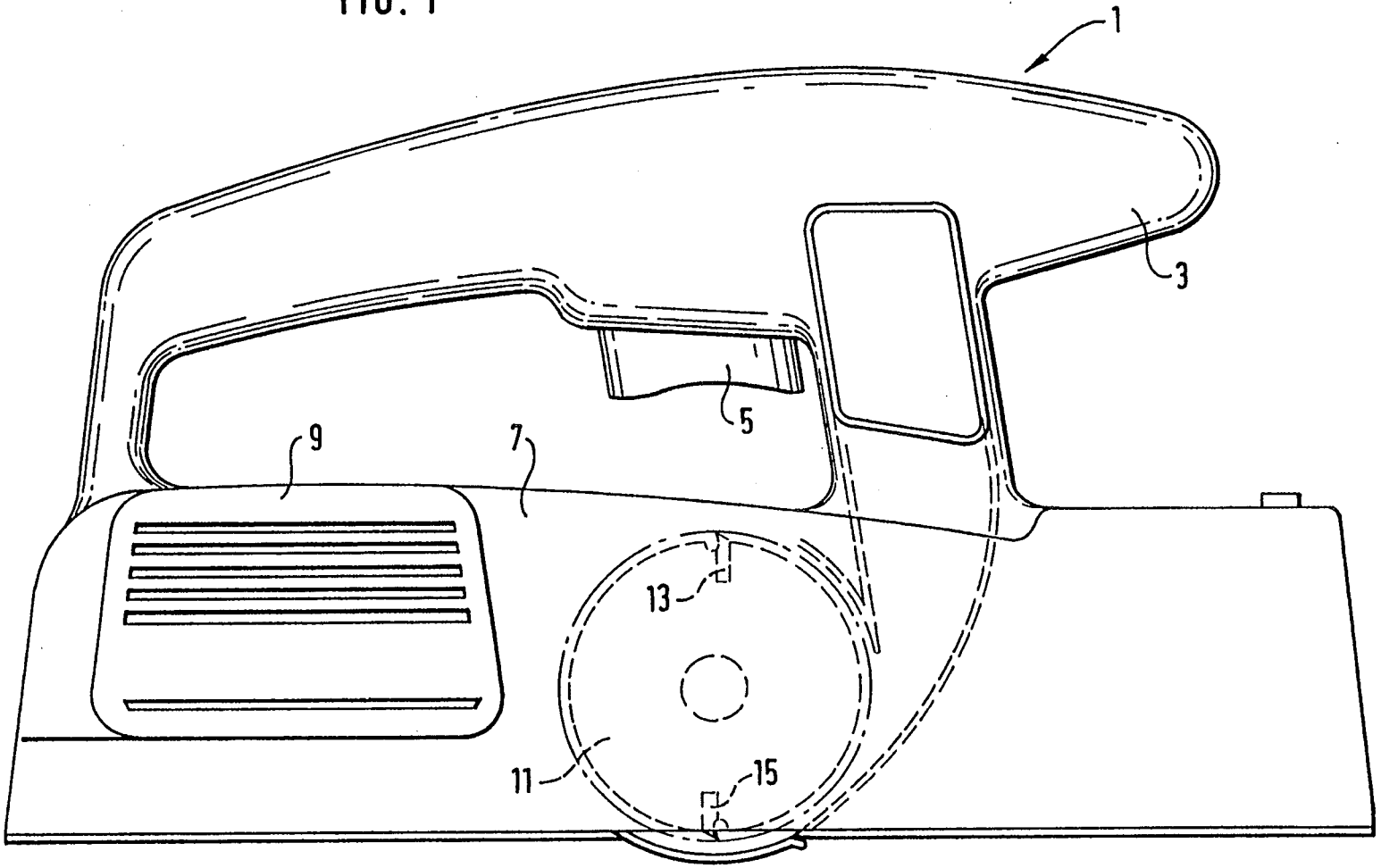
FIG. 1 is a side view of a hand-operated planer showing the position of the planing blades.

The side view shown in FIG. 1 shows a hand-operated planer 1 with a handle 3 which carries an on/off switch 5 and is part of the machine-tool housing 7. A motor, not shown in detail, is arranged under a cover shell 9 and drives a blade holder 11 in rotation. The blade holder 11 is shown in dashed lines. Two planing blades 13, 15 which are clamped on the blade holder 11 in a manner not shown in detail and have cutting edges, not shown in more detail, which are directed outward radially are arranged on two opposite sides of the outer surface area of the cylinder-like blade holder 11.

Figure 2:
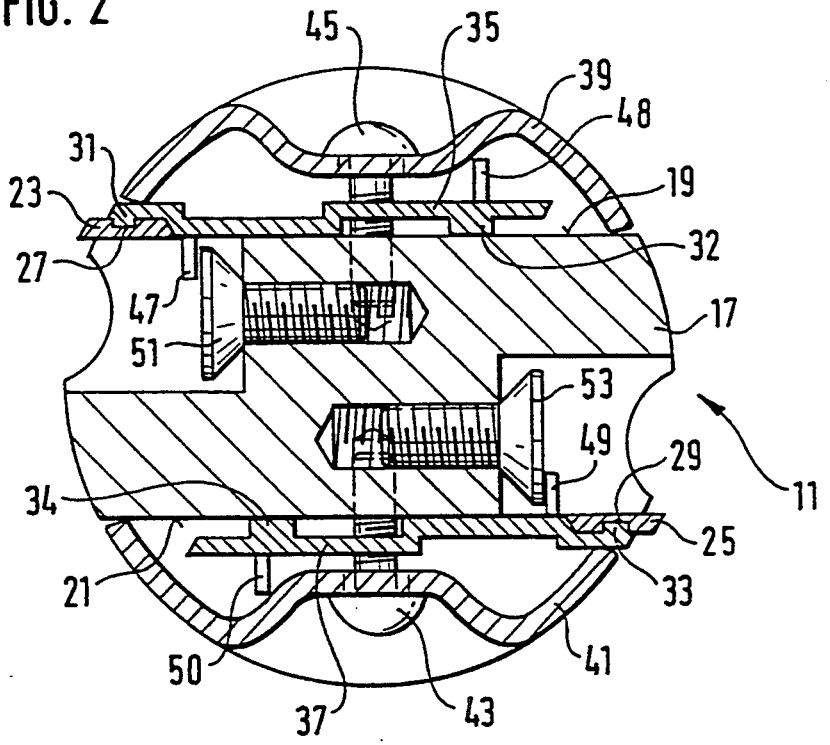
FIG. 2 shows a side view of a blade holder with hard-metal reversible planing blades.

A sectional view of the blade holder 11 in FIG. 2 shows a base body 17 corresponding to a cylinder which is flattened on two opposite sides of its circumference. Each of the two identical flattened sides 19, 21 carries an identical hard-metal reversible planing blade 23, 25 whose cutting edge, not shown in detail, projects over the circumference of the base body 17. Each of the two planing blades 23, 25 is secured relative to the base body 17 by one of two identical pressing plates 35, 37.

Each hard-metal reversible planing blade 23, 25 carries a slot 27, 29 on its side remote of the flattened side 21, 29. Protuberances 31, 33 of two identical pressing plates 35, 37 project into these slots 27, 29 so as to engage with them. Two identical cover shells 39, 41 are supported on the side of the pressing plates 35, 37 remote of the protuberances 31, 33 by a terminating clamping surface, not shown in detail, and in this way press the hard-metal reversible planing blades 23, 25 against the flattened sides 19, 21 of the base body 17 so as to be secured against displacement. Each cover shell 39, 41 is supported at the flattened sides 19, 21 by a second clamping surface located opposite the terminating clamping surface so as to be pulled by a clamping screw 43, 45 which is screwed to the base body 17 and passes through the cover shells 39, 41 and the pressing plates 35, 37. Two stops 47, 49 arranged at the pressing plates 35, 37 pass through recesses, not shown in detail, in the base body 17 and are directed toward the side remote of the cover shells 39, 41. Two adjusting screws 51, 53 which carry along the pressing plates 35, 37 when screwed out are associated with the stops 47, 49.

Two additional matching stops 48, 50 are identical to the stops 47, 49 with respect to function—just as the two additional protuberances 32, 34 are identical to the protuberances 31, 33—although with a different position of the pressing plates 35, 37 and with the use of differently constructed planing blades. This will be discussed below with reference to FIG. 3.

Figure 3:
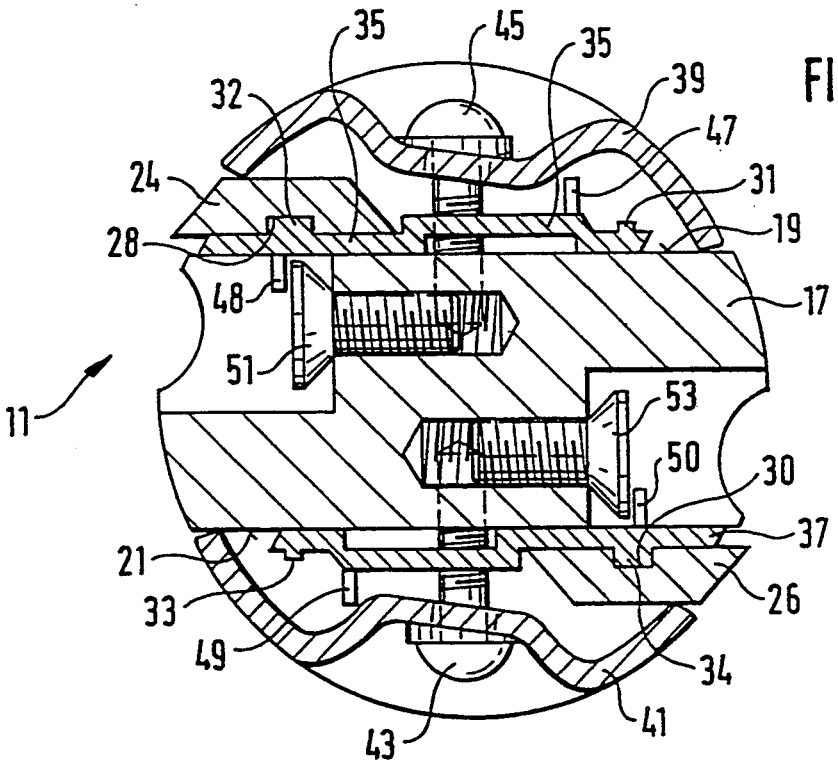
FIG. 3 shows a side view of a blade holder with high-speed steel reversible planing blades.

The sectional view shown in FIG. 3 differs from the embodiment example shown in FIG. 2 only in that high-speed steel reversible planing blades 24, 26 are arranged instead of the hard-metal reversible planing blades and in that the position of the pressing plates 35, 37 is different and wedge-shaped washers are arranged under the clamping screws 43, 45. For this reason the same reference numbers are used for identical components in FIG. 2.

The blade holder 11 includes a base body 17 corresponding to a cylinder which is flattened along its circumference on two opposite sides. Each of the two identical flattened sides 19, 21 carries an identical high-speed steel reversible planing blade 24, 26 whose cutting edges, not shown in detail, project over the circumference of the base body 17. The two planing blades 24, 26 are fixed relative to the base body 17 by the two identical pressing plates 27, 29 functioning as washers and, in so doing, engage over the protuberances 32, 34 of the pressing plates 37, 39 with their slots 28, 30. The two identical cover shells 39, 41 are supported on the sides of the planing blades 24, 26 remote of the slots 28, 30 by a terminating clamping surface, not shown in more detail, and in this way press the planing blades 24, 26 against the pressing plates 37, 39 so as to secure them against displacement. Each cover shell 39, 41 is supported at the flattened side 19, 21 by a second clamping surface, not shown in particular, located opposite the terminating clamping surface so as to be pulled by a clamping screw 43, 45 which is screwed to the base body 17, passes through the cover shells 39, 41 and the pressing plates 35, 37, and acts on the latter via a wedge-shaped washer. The two stops 48, 50 pass through recesses, not shown in detail, in the base body 17 and are directed toward the side remote of the cover shells 39, 41. Two adjusting screws 51, 53 which carry along the pressing plates 35, 37 when screwed out are associated with the stops 47, 49.

It can be seen in FIG. 3 that the stops 48, 50 facing the cover shells 39, 41 and having no discernible function according to FIG. 2 serve as adjusting means when the pressing plates 35, 37 are reversed and that the stops 47, 49 which are used for adjustment in FIG. 2 have no function in the reversed position according to FIG. 3 until they are reversed again, if necessary, for receiving hard-metal reversible planing blades instead of high-speed steel reversible planing blades 24, 26.

It can be seen in FIGS. 2 and 3 that by reversing the pressing plates 35, 37 they can be brought into alternating holding positions in which they optionally secure high-speed steel reversible planing blades 24, 26 or hard-metal reversible planing blades 23, 25 in a positively engaging manner on their base or rear surface which serves as a holding surface.

The pressing plates 27, 29 are part of the basic equipment of the hand-operated planers and are accordingly always available so that either high-speed steel reversible planing blades or hard-metal reversible planing blades 24, 26, 23, 25 can be clamped indifferently in an adjustable manner as required or depending on availability. Accordingly both types of planing blades can be clamped by the cover shells 39, 41 with the same reliability without special adaptation.

The hard-metal reversible planing blades 23, 25 are mounted and adjusted in the following manner:

After placing the hard-metal reversible planing blades 23, 25 on the flattened sides 19, 21 of the base body 17 and placing the pressing plates 35, 37 and subsequently fastening the cover shells 39, 41 on the base body 17 by means of clamping screws 43, 45, the hard-metal reversible planing blades 23, 25 are adjusted by turning the adjusting screws 51, 53 so that the orbit of the cutting edges (not shown) of the hard-metal reversible planing blades 23, 25 is arranged on predetermined coordinates with respect to the axis of rotation of the base body 17 and good cutting performance can be achieved. The hard-metal reversible planing blades 23, 25 are carried along into the desired position by the pressing plates 35, 37 via the stops 47, 49. After adjustment, the clamping screws 51, 53 are turned until achieving the prescribed clamping moment.

The high-speed steel reversible planing blades 24, 26 are mounted and adjusted in the following manner:

After placing the pressing plates 35, 37 on the flattened sides 19, 21 of the base body 17 and placing the high-speed steel reversible planing blades 24, 26 and subsequently fastening the cover shells 39, 41 on the base body 17 by means of clamping screws 43, 45, the high-speed steel reversible planing blades 24, 26 are adjusted by turning the adjusting screws 51, 53 so that the orbit of the cutting edges (not shown) of the planing blades 24, 26 is arranged on predetermined coordinates with respect to the axis of rotation of the base body 17 and good cutting performance can be achieved. The high-speed steel reversible planing blades 24, 26 are carried along into the desired position by the pressing plates 35, 37 via the stops 48, 50. After adjustment, the clamping screws 51, 53 are turned until the prescribed clamping moment is reached and the inclined position of the cover shells 39, 41 is compensated for by wedge-shaped washers, not shown in detail.

Figure 4:
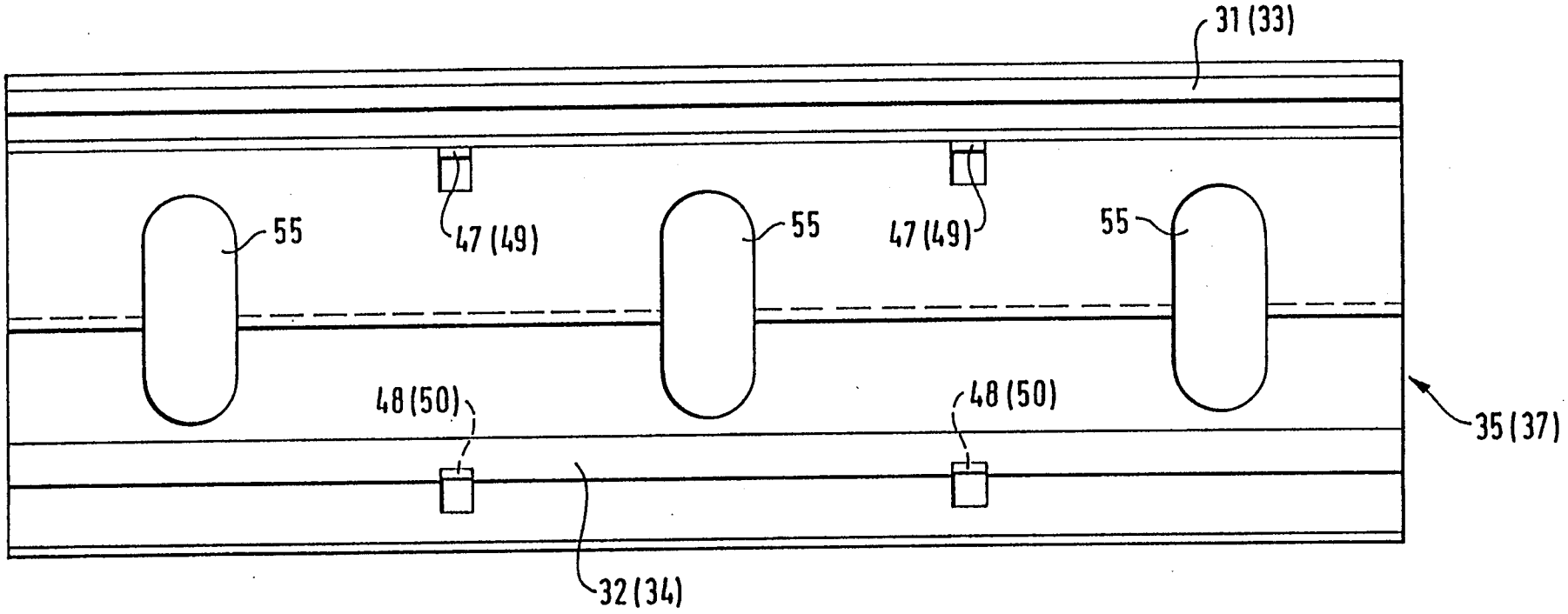
FIG. 4 shows a top view of a pressing plate mounted on the blade holder.

The top view of one of the pressing plates 35 or 37 shown in FIG. 4 shows the edges of the protuberances 31 or 33 and 32 or 34 and the stops 47 or 49 and 48 or 50 and openings 55 which are constructed as elongated holes.

It will be understood that each of the elements described above, or two or more together, may also find a useful application in other types of constructions differing from the types described above.

While the invention has been illustrated and described as embodied in a hand-operated planer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A hand-operated planer, comprising a rotating blade holder having a base body; at least one planing blade; and a reversible pressing plate having one side which presses said planing blade against said base body in one clamping position and another side which is formed differently from said one side so that when said pressing plate is reversed to assume another clamping position said another side can press another planing blade which is different from said one planing blade against said base body, said one side of said pressing plate having a first gripping formation engageable only with said one planing blade while said another side of said pressing plate has a second gripping formation which is different from said first gripping formation and engages said another planing blade.

2. A hand-operated planer as defined in claim 1; and further comprising a cover shell which clamps said pressing plate against said base body, and a clamping screw by means of which said cover shell clamps said pressing plate against said base body.

3. A hand-operated planer as defined in claim 1, wherein one of said planing blades is a hard-metal reversible planing blade, while another of said planing blades is a high-speed steel reversible planing blade with a smooth back and a profiled base.

4. A hand-operated planer as defined in claim 3, wherein said profiled base has a slot.

5. A hand-operated planer as defined in claim 1, wherein said pressing plate has two opposite ends, said gripping formations being located at said opposite ends.

6. A hand-operated planer as defined in claim 3; and further comprising a cover shell which clamps said pressing plate against said base body, said high-steel reversible planing blade having one side resting on said pressing plate and another opposite side on which said cover shell is supported.

7. A hand-operated planer as defined in claim 6, wherein said pressing plate has a nose-like projection forming one of said gripping formations while said high-speed steel reversible planing blade has a slot which reverses on said nose-like projection.

8. A hand-operated planer as defined in claim 3; and further comprising a cover shell which clamps said pressing plate against said base body, said hard-metal reversible planing blade having one side which rests directly on said base body, and also another opposite side on which said pressing plate is supported so that said cover shell is supported on said pressing plate.

9. A hand-operated planer as defined in claim 8, wherein said another surface of said hard-metal reversible planing blade has a slot, said pressing plate having a nose-like projection supported in said slot and forming one of said gripping formations.

10. A hand-operated planer as defined in claim 1, wherein said pressing plate is provided with a plurality of openings for clamping screws.

11. A hand-operated planer as defined in claim 10, wherein said openings for said clamping screws are formed as elongated holes.

12. A hand-operated planer as defined in claim 1, wherein said pressing plate has a plurality of stops for adjusting screws.

13. A hand-operated planer as defined in claim 7, wherein said nose-like projection extends over an entire length of said blade.

14. A hand-operated planer as defined in claim 9, wherein said nose-like projection extends over an entire length of said planing blade.

15. A hand-operated planer as defined in claim 1, wherein said pressing plate grips said planing blade over an entire length of said planing blade.

16. A hand-operated planer as defined in claim 1, wherein said pressing plate grips said planing blades over an entire length of said planing blades.

17. A hand-operated planer as defined in claim 1, wherein said gripping formations are arranged so that in order to assume said one position and said another position, said pressing plate is turned by 180° about a first axis and also by 180° about a second axis extending perpendicular to said first axis.

18. A hand-operated planer set, comprising a rotating blade holder having a base body; at least two planing blades and a reversible pressing plate adapted to alternatively clamp a respective one of said planing blades against said base body, said pressing plate having one side which presses said planing blades against said base body in one clamping position and another side which is formed differently from said one side so that when said pressing plate is reversed to assume another clamping position said another side can press another planing blade which is different from said planing blade against said base body, said one side of said pressing plate having a first gripping formation engageable only with said one planing blade while said another side of said pressing plate has a second gripping formation which is different from said first gripping formation and engages said another planing blade.

19. A hand-operated planer as defined in claim 18, wherein said gripping formations are arranged so that in order to assume said one position and said another position, said pressing plate is turned by 180° about a first axis and also by 180° about a second axis extending perpendicular to said first axis.

* * * * *